US005755676A

United States Patent [19]

Chen

[11] Patent Number: 5,755,676

[45] Date of Patent: May 26, 1998

[54] VIBRATING MASSAGER

[76] Inventor: Harrison Chen, No. 2, Lane 79, Gaun Kuang St., Panchiao, Taipei Hsien, Taiwan

[21] Appl. No.: 780,620

[22] Filed: Jan. 8, 1997

[51] Int. Cl.[6] ..... A61H 23/02; A61H 23/00

[52] U.S. Cl. ..... 601/82; 601/101; 601/103; 601/104; 601/51

[58] Field of Search ..... 601/46, 48, 82, 601/83, 84, 97, 101, 103, 104, 27, 28, 29, 30, 51, 78, 134

[56] References Cited

U.S. PATENT DOCUMENTS 800,489 1/1905 Richmond et al. ..... 601/82
3,830,232 8/1974 McNair ..... 601/27
3,965,495 6/1976 McNair ..... 601/27
4,599,997 7/1986 Bucher ..... 601/30
4,802,463 2/1989 Rojas ..... 601/56

*Primary Examiner*—Robert A. Hafer
*Assistant Examiner*—Benjamin K. Koo
*Attorney, Agent, or Firm*—Morton J. Rosenberg; David I. Klein; Jun Y. Lee

[57] ABSTRACT

The transmission mechanism of the vibrating massager includes a stator, a movable frame supported on springy members and movably mounted around the stator, and a magnetic coil mounted around the stator and fixedly secured to the movable frame and energized to produce a magnetic force, causing the movable frame to be reciprocated relative to the stator.

3 Claims, 6 Drawing Sheets

VIBRATING MASSAGER

BACKGROUND OF THE INVENTION

The present invention relates to a vibrating massager that vibrates by means of a reciprocating motion of a transmission mechanism.

A variety of massaging apparatus have been disclosed for massaging different parts of the body, and have appeared on the market. There is known a handy vibrating massager designed for massaging the sole of the leg. This vibrating massager uses a motor to turn cam, causing the cam to vibrate a shell, which has massaging elements raised on the outside. This vibrating massager has drawbacks. When the cam is turned to vibrate the shell, a high noise will be produced. Another drawback of this structure of vibrating massager is its weak vibrating force. In order to increase the vibrating force, the size of the cam and the capacity of the motor must be relatively increased. However, increasing the size of the cam and the capacity of the motor makes the vibrating massager heavy.

SUMMARY OF THE INVENTION

It is one object of the present invention to provide a vibrating massager which produces low noise during its operation. It is another object of the present invention to provide a vibrating massager which is compact. According to the preferred embodiment of the present invention, the vibrating massager is comprised of a cover shell, and a transmission mechanism mounted inside the cover shell. The cover shell has a plurality of massaging elements on the outside, a front seat and two opposite lateral seats on the inside. The transmission mechanism comprises a stator, a movable frame movably mounted around the stator and supported on needle rollers at two opposite sides of the stator, springy members respectively connected between the movable frame and the front and lateral seats of the cover shell, and a magnetic coil mounted around the stator and fixedly secured to the movable frame and energized to produce a magnetic force, causing the movable frame to be reciprocated relative to the stator.

DETAILED DESCRIPTION OF THE PREFERRED EMBODIMENT

Figure 1:
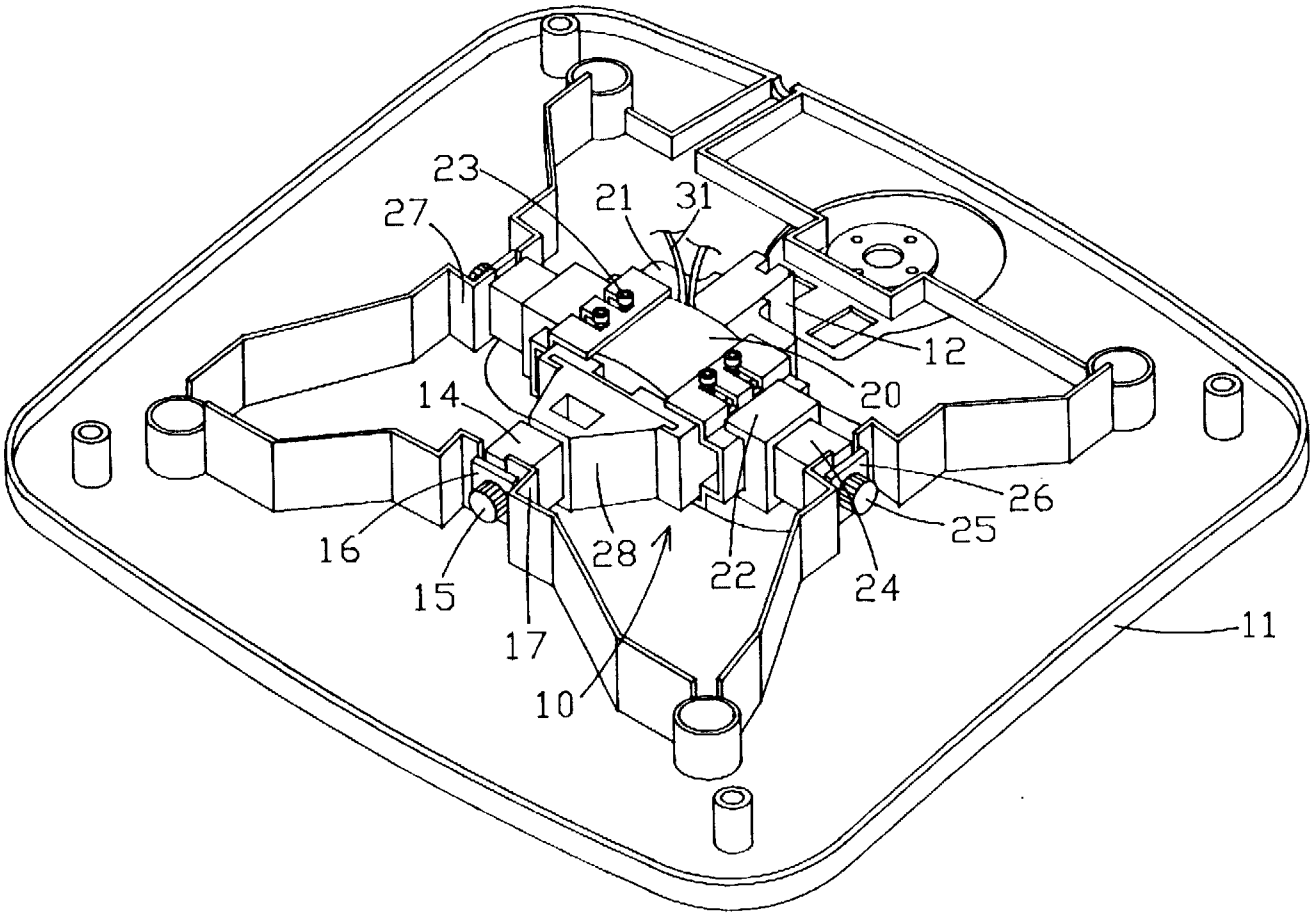
FIG. 1 shows a transmission mechanism mounted inside a cover shell according to the present invention.
Figure 2:
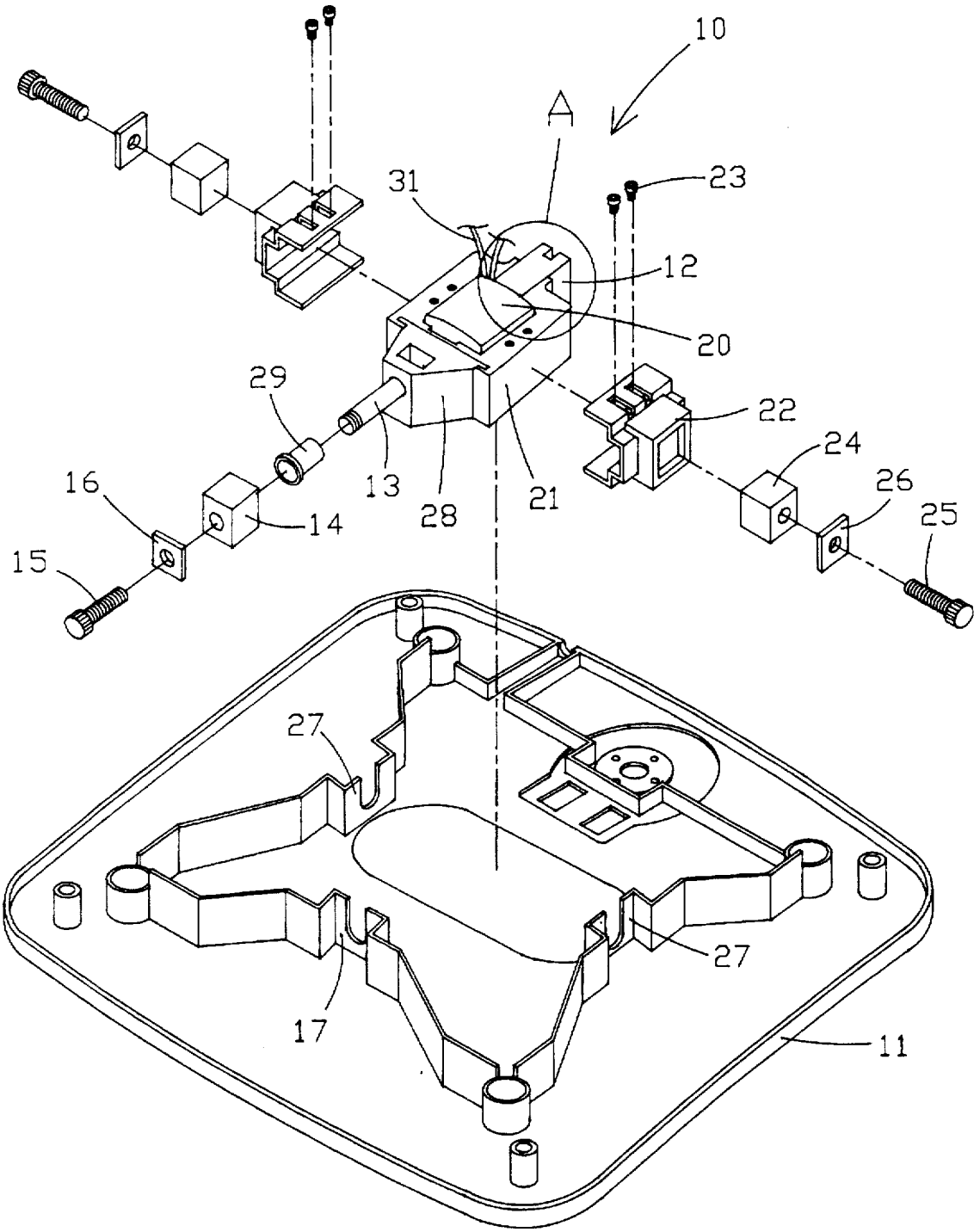
FIG. 2 is an exploded view of FIG. 1.
Figure 2A:
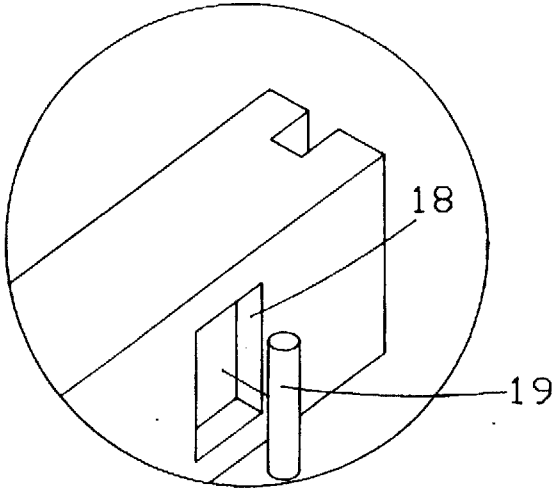
FIG. 2A is an enlarged view of a part of the stator shown in FIG. 2.
Figure 3:
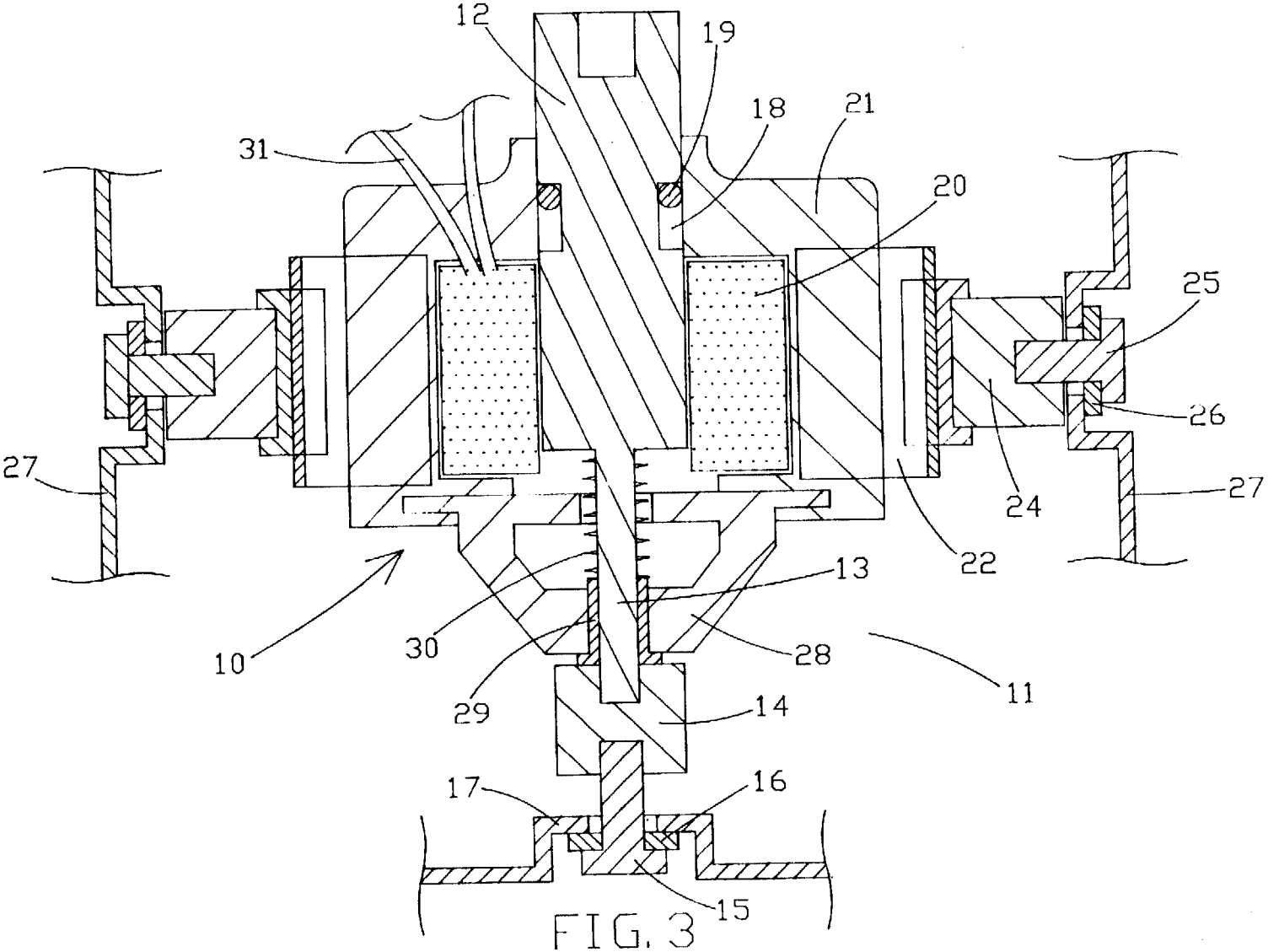
FIG. 3 is a top plain view in an enlarged scale of the vibrating massager shown in FIG. 2.

Referring to FIGS. 1, 2, and 3, a transmission mechanism 10 is mounted inside a cover shell 11. The cover shell 11 comprises a front seat 17 arranged in X-axis direction, and two opposite lateral seats 27 arranged in Y-axis direction The transmission mechanism 10 comprises a substantially rectangular stator 12. The stator 12 comprises two recesses 18 at two opposite lateral sides, two needle rollers 19 respectively mounted in the recesses 18, and a forward axle 13 extended from the front side. The forward axle 13 is connected to the front seat 17 of the cover shell 11 by a springy member 14, a screw 15 and a washer 16. The springy member 14 is coupled between the forward axle 13 and the screw 15. A movable frame 21 is mounted around the stator 12 and supported on the needle rollers 19, and moved back and forth relative to the stator 12. A magnetic coil 20 mounted around the stator 12, and fixedly fastened to the movable frame 21, having two lead wires 31 respectively connected to power supply. A cap 28 is coupled to the movable frame 21 and mounted around the forward axle 13. A lubricating socket 22 is mounted around the forward axle 13 within the cap 28. A spring 30 is mounted around the forward axle 13, and stopped between the lubricating socket 29 and the stator 12. The spring 30 imparts a forward pressure to the lubricating socket 29 against the springy member 14. Two holder frames 22 are fixedly secured to two opposite lateral sides of the movable frame 21. Two springy members 24 are respectively mounted in the holder frames 22, and connected to the lateral seats 27 of the cover shell 11 by a respective screw 25 and a respective washer 25.

Figure 4:
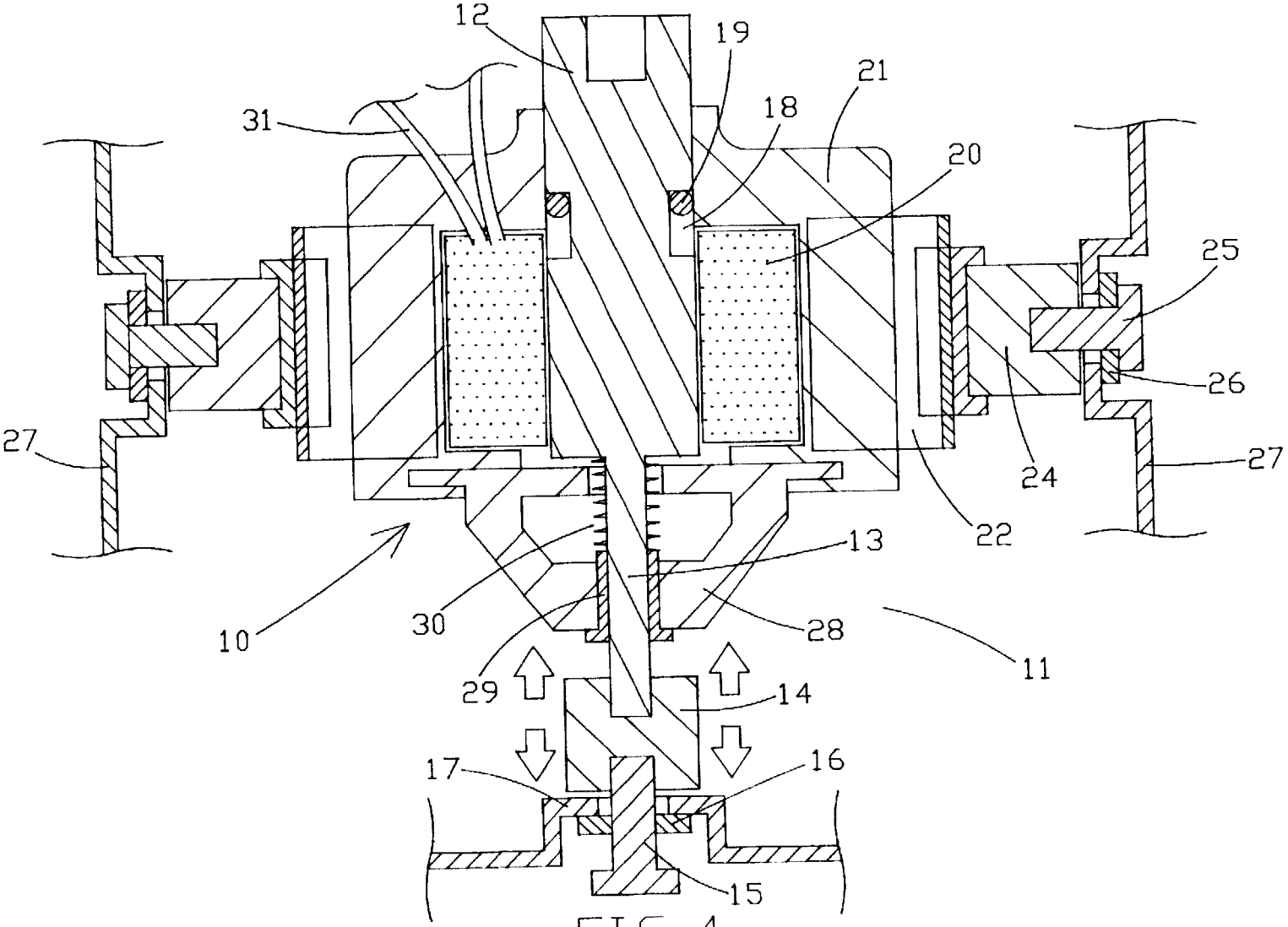
FIG. 4 is similar to FIG. 3 but showing the movable frame reciprocated.

Referring to FIG. 4, when electric current is transmitted to the magnetic coil 20 through the lead wires 31, a magnetic force is produced between the magnetic coil 20 and the stator 12, thereby causing the magnetic coil 20 with the movable frame 21 to be moved back and forth relative to the stator 12. When the movable frame 21 is reciprocated, the cover shell 11 is caused to vibrate.

Figure 5:
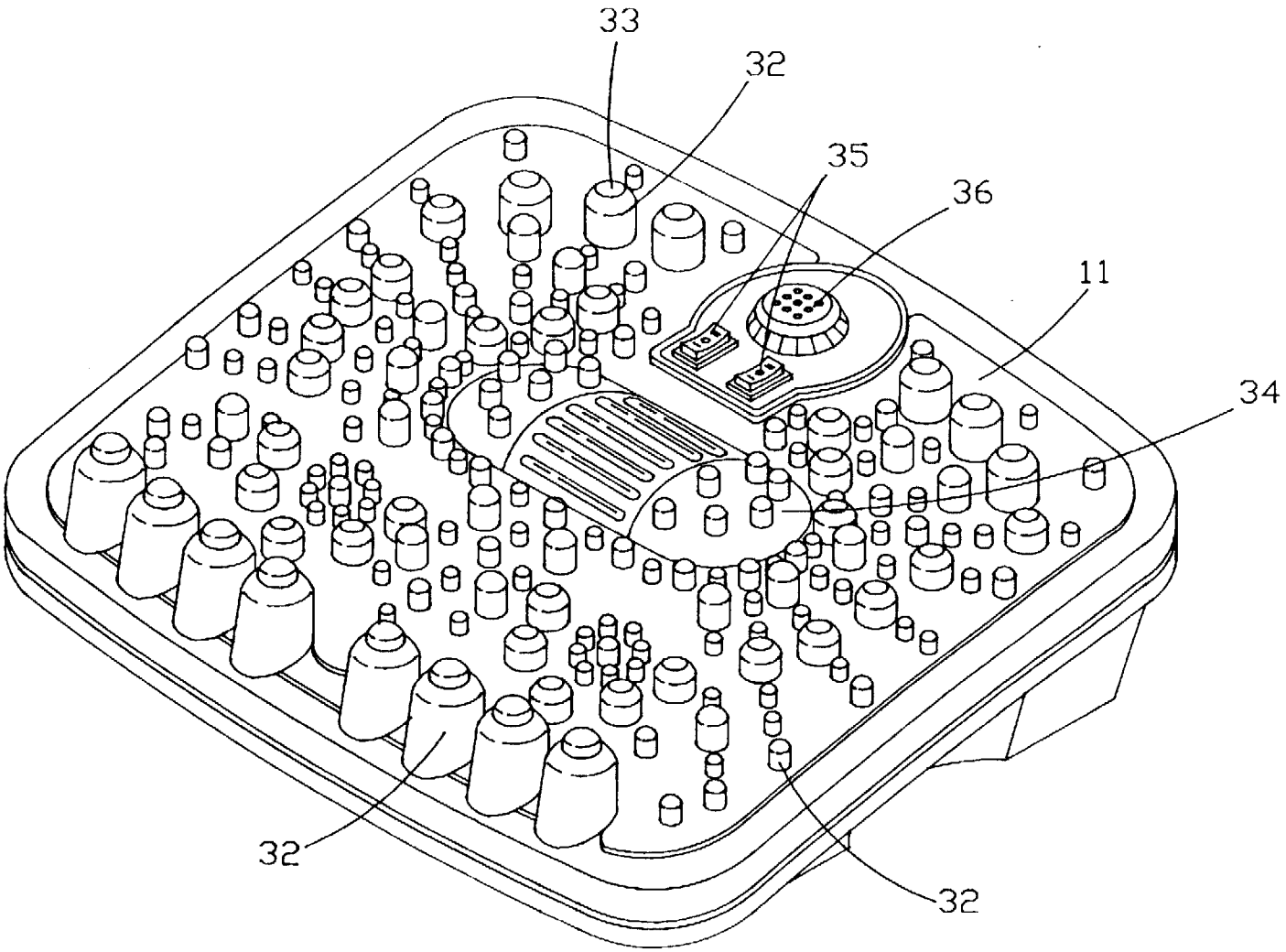
FIG. 5 is an elevational view of the vibrating massager shown in FIG. 2, showing the outside structure of the cover shell.

Referring to FIG. 5, the cover shell 11 has a plurality of massaging elements 32 of different sizes raised from the outside for massaging. Magnetic elements 33 are respectively mounted on the massaging elements 32 at the top. A convex infrared massaging means 34 is mounted on the cover shell 11 to emit infrared for stimulate the circulation of blood. A switch 35 and a timer 36 are mounted on the cover shell 11 on the outside, and respectively connected to the aforesaid lead wires 31 for controlling power supply and setting operating time.

As the transmission mechanism is supported on springy members and driven to reciprocate by means of magnetic force, less noise is produced during its operation.

While only one embodiment of the present invention has been shown and described, it will be understood that various modifications and changes could be made thereunto without departing from the spirit and scope of the invention disclosed.

What the invention claimed is:

1. A vibrating massager comprising a cover shell, and a transmission mechanism reciprocated to vibrate said cover shell for massaging, wherein said cover shell comprises a front seat and two opposite lateral seats respectively disposed on the inside; said transmission mechanism comprises:

a stator having two recesses at two opposite lateral sides, two needle rollers respectively mounted in said recesses, and a forward axle at a front side thereof;

a first springy member connected between the front seat of said cover shell and the forward axle of said stator by a screw and a washer;

a movable frame mounted around said stator and supported on said needle rollers, and moved back and forth relative to said stator;

a magnetic coil mounted around said stator and fixedly fastened to said movable frame, and energized to induce a magnetic force, causing said movable frame to be reciprocated relative to said stator;

a cap coupled to said movable frame and mounted around aid forward axle;

a lubricating socket mounted around said forward axle within said cap;

a spring mounted around said forward axle, and stopped between said lubricating socket and said stator;

two holder respectively and fixedly secured to said movable frame at two opposite sides; and two second springy members respectively mounted in said holder frames, and connected to the lateral seats of said cover shell by a respective screw and a respective washer.

2. The vibrating massager of claim 1 wherein said cover shell comprises a plurality of massaging elements of different sizes respectively raised from the outside, and a plurality of magnetic elements respectively mounted in said massaging elements.

3. The vibrating massager of claim 1 wherein said cover shell is mounted with infrared massaging means on the outside.

* * * * *